United States Patent [19]

Kulitz

[11] Patent Number: 4,801,376

[45] Date of Patent: Jan. 31, 1989

[54] CLEANER FOR SWIMMING POOLS AND THE LIKE

[75] Inventor: Gunter Kulitz, Ulm/Donau, Fed. Rep. of Germany

[73] Assignee: ESTA Apparatebau GmbH & Co. KG, Fed. Rep. of Germany

[21] Appl. No.: 48,985

[22] Filed: May 11, 1987

Related U.S. Application Data

[63] Continuation of Ser. No. 709,386, Mar. 7, 1985, abandoned.

[30] Foreign Application Priority Data

Mar. 23, 1984 [DE] Fed. Rep. of Germany ..... 3410817

[51] Int. Cl.[4] ..... B01D 29/10

[52] U.S. Cl. ..... 210/123; 210/169; 210/136; 210/241; 210/416.1; 417/40; 417/17; 15/320; 15/339; 134/21

[58] Field of Search ..... 210/169, 416.1, 513, 210/523, 525, 806, 123, 136, 241; 15/1.7, 349, 339, 321, 320; 134/21, 6, 167 R; 137/205, 566; 417/17, 40

[56] References Cited

U.S. PATENT DOCUMENTS

| | | | |
|---|---|---|---|
| 2,878,938 | 3/1959 | Dee | 210/169 |
| 3,012,676 | 12/1961 | Englesberg | 210/169 |
| 3,639,940 | 2/1972 | Carlson et al. | 15/349 |
| 3,694,263 | 9/1972 | Korn, Sr. | 134/3 |
| 4,080,104 | 3/1978 | Brown, Jr. | 417/40 |
| 4,431,538 | 2/1984 | Selsted | 210/169 |
| 4,574,048 | 3/1986 | van den Broek | 210/169 |

FOREIGN PATENT DOCUMENTS

| | | |
|---|---|---|
| 1850189 | 4/1962 | Fed. Rep. of Germany . |
| 2801394 | 7/1979 | Fed. Rep. of Germany . |
| 1584027 | 2/1981 | Fed. Rep. of Germany . |
| 8303350 | 8/1983 | Fed. Rep. of Germany . |
| 875403 | 8/1961 | United Kingdom . |
| 1336117 | 11/1973 | United Kingdom . |

*Primary Examiner*—Peter Hruskoci
*Assistant Examiner*—Coreen Y. Lee
*Attorney, Agent, or Firm*—Steele, Gould & Fried

[57] ABSTRACT

A cleaner has in a tank a vacuum pump protected by a float valve above the maximum possible water level and a submersible pump at the bottom and both of these in the tank produce a vacuum for the suction of water against the vacuum, the submersible pump moving the filtered water collected in the lower region of the tank out of the tank past a check valve. The vacuum pump is constructionally combined with a tank cover, so that it can be mounted on differently constructed tanks for different cleaning functions. For wet suction purposes, the associated paper filter bag has a passage opening for the suction connecting pieces, so that the water to be filtered passes through the filter from the inside to the outside.

40 Claims, 1 Drawing Sheet

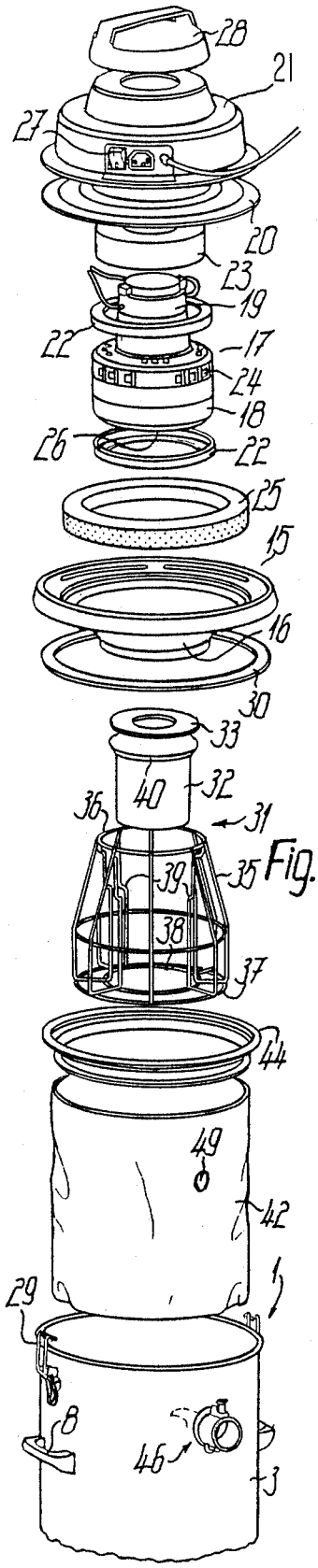
Fig.2
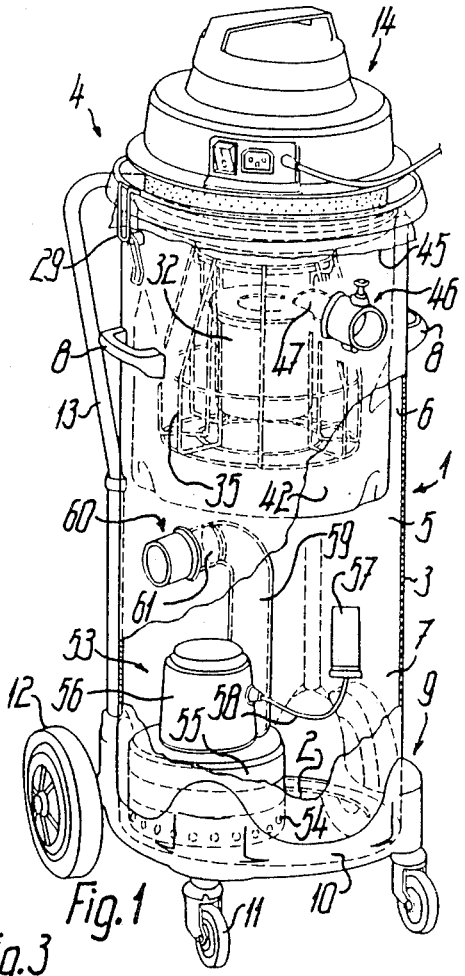
Fig.1
Fig.3
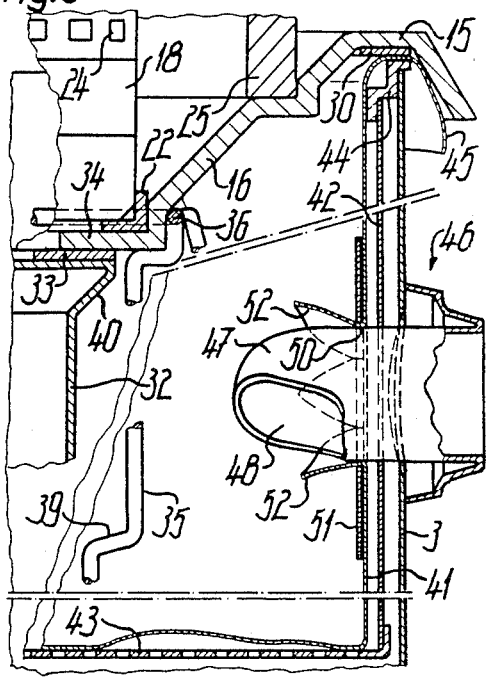

CLEANER FOR SWIMMING POOLS AND THE LIKE

This is a continuation of application Ser. No. 709,386, filed Mar. 7, 1985, now abandoned.

BACKGROUND OF THE INVENTION

The present invention relates to a mobile cleaner for swimming pools or the like, with a suction mechanism for the liquid to be cleaned which has a suction connection, a wet filter arranged in the liquid flow path and a recycling mechanism for the cleaned liquid having a pressure connection and, for example, a pump.

Usually, two different types of devices are used for cleaning swimming pools, particularly the bottom of swimming pools. The aforementioned type of device generally is self-propelled by means of a roller driven by an electric motor and moves over the bottom of the swimming pool and by means of a pump sucks up water with dissolved dirt, forces it through a wet filter on the high pressure or outlet side, usually in the form of a filter bag, and then returns the filtered water to the swimming pool again. In such devices, the pump is part both of the suction mechanism and the recycling mechanism for the cleaned liquid. Such devices are relatively difficult to use and in particular are difficult to remove from the swimming pool again, while having the further disadvantage that they take a relatively long time to clean a swimming pool. On raising the device out of the swimming pool, frequently unfiltered, very dirty water often flows back out of the device into the swimming pool.

The other type of device generally has a suction nozzle guided by a rod or tube and which is connected by a hose to the swimming pool surface suction means, namely the so-called skimmer. The sucked up dirt is held back in the swimming pool filter which is associated in stationary manner with the swimming pool, so that the filter is very rapidly contaminated, e.g. with leaves. There are also very high back flushing losses of the swimming pool water, because such filters must be cleaned by back flushing and removing the back-flushed water. The coarse dirt obtained during the cleaning of the pool also leads to unhygienic contamination of the swimming pool filter, which is constantly in contact with the pool water.

Finally, industrial dirt suction means are known, which can be used for liquids as well as dry dirt. However, such means suck the liquid into a tank which has to be emptied and whose capacity is naturally very limited, even if an additional preliminary water filter is interposed.

SUMMARY OF THE INVENTION

An object of the present invention is to provide a cleaner of the aforementioned type which has a compact construction, ensures a high efficiency and has only a limited susceptibility to faults.

According to the invention, this and other objects are achieved by a cleaner of the aforementioned type wherein the suction and recycling mechanisms are connected on the suction side to an air-containing vacuum chamber into which issues the suction connection, while in the liquid flow path, the recycling mechanism is positioned downstream of the wet filter. As a result, the dirty water can be sucked up with a high specific power output and without having to pass through any movable machine parts, after which it is supplied to a very large-area filter which, as a result of its size, can be set to very fine filtering without impairing the throughput. Thus, the recycling mechanism is only exposed to the action of the filtered water, so that it is not subject to faults or damage caused by dirt.

It is possible to seal the suction connection of the cleaner or the suction nozzle to be moved in the swimming pool, for suction purposes, e.g. by holding it closed with the hand until an adequate vacuum has been built up in the vacuum cleaner. However, it is advantageous in the case of larger cleaners if, according to a further feature of the invention, a check valve, particularly a leaf valve located in a pressure line is provided between the suction side and the pressure connection of the recycling mechanism. The leaf valve closes in the case of an overpressure on the outlet side. Thus, the recycling mechanism always operates against the vacuum in the vacuum chamber and consequently helps to maintain the vacuum, or produces or at least maintains this vacuum unchanged.

A very compact cleaner construction is obtained if the suction opening of the recycling mechanism and the vacuum chamber are superimposed in a common main chamber, particularly an upright tank. The vacuum chamber is in particular formed by the pressure-tight area above the liquid level of an intermediate liquid reservoir in the main chamber. The intermediate reservoir avoids in simple manner the recycling mechanism running dry, although it is also possible to provide a pump which has good dry operation characteristics. As the intermediate reservoir communicates with the vacuum chamber, on sucking filtered water from the intermediate reservoir the vacuum in the vacuum chamber increases and consequently so does the suction efficiency of the suction mechanism.

It has proved advantageous to form the suction mechanism and the recycling mechanism by separate units, which are preferably driven by separate motors, e.g. electric motors. As a result, it is possible without having mechanical drive connections between the two mechanisms to accuracely match their delivery efficiencies to one another, as a function of requirements. However, it is also conceivable to form the two mechanisms by an independent self-priming water pump, or to constructionally combine the mechanisms in such a way that a single motor drives both an exhauster and a pump, the suction port of the exhauster then issuing into the vacuum chamber and the suction port of the pump into the intermediate reservoir, which can also be formed by a container separate from the vacuum chamber. However, it is particularly appropriate for a separate motor exhauster and a motor pump to be individually structurally combined with the tank.

The pump can be positioned in simple manner, e.g in the form of a submersible pump below the vacuum chamber, preferably on the bottom of the main chamber, so that it contributes to a low centre of gravity position of the cleaner. Appropriately, at least one suction port is in the immediate vicinity of the bottom and the pressure line is led out of the main chamber in pressure-tight manner, so that vacuum losses in the vacuum chamber are avoided and the intermediate reservoir can at least be almost completely emptied by the pump.

The delivery efficiencies of the suction mechanism and the recycling mechanism can be matched to one another in a very simple manner in that the recycling mechanism is controlled as a function of the liquid level in the cleaner, preferably by a float switch. If the recycling mechanism is matched to the suction mechanism in such a way that the wet filter is located above the highest liquid level, the water can flow in unimpeded manner through the wet filter and this also avoids suspension by the filtered water of dirt retained in the wet filter. The pump is appropriately designed in such a way that it has a somewhat higher delivery efficiency than the exhauster, so that during operation it can be automatically switched off a number of times, e.g. through the float switch. When the pump is not delivering, suction back via the recycling mechanism outlet is prevented by the aforementioned check valve.

A particularly advantageous further development of the invention results from the fact that the suction mechanism is arranged on the top of the vacuum chamber and preferably with the suction side detachably connects the wet filter and/or the vacuum chamber to an upper opening, the suction mechanism in particular forming a tank cover and/or a ring locking means for the wet filter. Thus, the suction mechanism can be mounted as a suction head or tank cover on a different tank which, in place of a recycling mechanism, has a dust storage bin as an intermediate reservoir, consequently forming therewith a high efficiency moisture or duct exhauster. In this case, the suction connection leading into the tank issues into the latter in such a way that between its opening and the suction side of the suction mechanism is located the filter or filter bag, so that dirt does not flow through the suction mechanism.

In the case of the cleaner for swimming pools according to the invention, the suction connection appropriately opens out below the suction mechanism and particularly obliquely downwardly directed into the vacuum chamber, it being preferably formed by a connecting piece inserted radially in the tank wall, so that there is virtually no risk of water being sucked into the suction mechanism. Both the suction mechanism and the recycling mechanism consequently operate in uncontaminated medium, namely the suction mechanism with air and the recycling mechanism with filtered water.

The penetration of water into the suction mechanism can be completely prevented, even under unfavourable conditions, through a float valve being associated with the suction port of the suction mechanism. The valve preferably has a float in the tank axis and which is guided in a support cage or the like for the wet filter constructionally combined with the suction mechanism and engaging in said filter and particularly in the initial position, its valve closing element is approximately level with the suction connection adjacent to its circumference. Through a lightweight and large-volume construction of the float, the latter responds even in the case of small quantities of water. Through providing a support cage for the wet filter, it can easily be held in large-area spread, despite the vacuum. If this support cage forms part of the tank cover, it is also effective when using another tank.

In order that the wet filter is able to cope with large quantities of water under high pressure without any risk of tearing, there is provided for receiving the wet filter, which is particularly constructed in interchangeable manner or as a disposable filter, a filter housing in the form of a preferably coated textile covering with a dimensionally stable, perforated bottom, e.g. a strainer, which in particular has a lateral opening for the sealed passage of the suction connection. This filter housing, which is e.g. provided with a rubber-like plastic coating and has a gauze character, supports the wet filter against the dirty water. If the wet filter is filled with dirt, it can be simply removed from the cleaner as a container receiving said dirt, it is then discarded and replaced by a new wet filter.

To further facilitate the replacement of the wet filter, it is fixed by jamming its upper, outwardly turned over edge against a profile ring sealing the top of the vacuum chamber and which preferably carries the filter housing and/or is multiply, radially, inwardly stepped from top to bottom. If the tank cover or suction mechanism is removed from the tank, the wet filter is freely accessible for removal.

It is conceivable to achieve the mobility of the cleaner by making it floatable, in such a way that the exhauster does not come into contact with water or is above the water level enabling the cleaner to be moved at random by floating in the swimming pool. However, it is particularly advantageous if the cleaner has a wheel frame, which is preferably provided with self-guiding casters, so that it can be moved round the outside of the swimming pool or can be pulled by a suction hose connected to its suction connection. A sink hose, whose outlet side end is below the water level in the pool is appropriately connected to the outlet of the recycling mechanism.

The invention also relates to a wet filter for a cleaner, particularly a cleaner of the aforementioned type which, in the form of a filter bag or the like of a paper web with a high hydraulic permeability, has in the covering an insertion opening for the suction connection which is preferably formed by a sleeve in the form e.g. of a flat, flexible reinforcement fixed to its inside and having an axially bounded passage opening for the suction connection. The filter bag or paper web is bound in moisture-tight manner. After insertion in the filter housing, the filter bag with its insertion opening is passed over the suction connecting piece of the suction mechanism, so that its opening is within the filter bag. The elastic reinforcement leads to a very reliable hold and good sealing. The reinforcement can e.g. be fixed to the paper web by a sewn seam.

BRIEF DESCRIPTION OF THE DRAWINGS

The invention is described in greater detail hereinafter relative to a non-limitative embodiment and with reference to the attached drawings, wherein show:

FIG. 1 is a perspective, partially broken away, of a cleaner according to the invention.

FIG. 2 is an exploded perspective of the suction and filtering means of the cleaner according to FIG. 1.

FIG. 3 is an axial section of an upper portion of the cleaner of FIG. 1.

DETAILED DESCRIPTION OF THE INVENTION

As shown in FIGS. 1 to 3, a cleaner according to the invention has a thin-walled, cylindrical, upright tank 1, whose lower end is closed by a bottom 2 connected in one piece with the tank casing 3, while the upper opening of the tank 1 corresponding to the inside diameter of the tank casing 3 is closed by a detachable tank cover 4. The tank 1, whose height is preferably approximately twice its diameter, surrounds a main chamber 5 having continuously identical cross-sections over its height and which in its upper, higher area forms an air-containing vacuum chamber 6 and in its lower area, e.g. taking up roughly one third of the overall height of the main chamber 5, an intermediate liquid reservoir 7. In the upper area on the outside of the tank casing 3 are provided two diametrically facing handles 8 for carrying the cleaner. In the represented embodiment, the cleaner is arranged on a four-wheeled wheel frame 9 constructed in the manner of a wheelbarrow and has a low stand chassis 10, i.e. at a limited distance above the running plane and on whose annular base stands the bottom of tank 1 in flush and removable manner. The stand chassis 10 has a multiple height-changing outer wall, which is directly adjacent to the outside of the tank casing 3, so that tank 1 is centered with respect to stand chassis 10 and is secured against lateral slipping. Two wheels at the front of the wheel frame 9 are constructed as self-guiding casters 11 of the type used on furniture, which are located completely below the underside of chassis 10. The two other larger diameter wheels 12 on the back of the wheel frame 9 and in a common axis are located externally on turned-away sides of chassis 10, their axis being higher than the underside of chassis 10, so that good rolling performance is obtained. At the rear, wheel frame 9 is provided with an approximately U-shaped bow grip 13, whose downwardly directed legs are fixed in corresponding wall attachments of stand chassis 10 and whose top, horizontal grip transverse web is provided roughly level with the upper end of the tank casing 3 and spaced from the outer circumference thereof. Thus, the cleaner with wheel frame 9 can be tilted about the axis of wheels 12 rearwards into a sloping position and can therefore be easily and rapidly transported over not particularly flat running surfaces without bottom contact of casters 11 on large wheels 12.

The tank cover 4 is constructionally combined with a preferably electrically operated suction mechanism 14 arranged substantially equiaxially to the tank. Suction mechanism 14 has a locking ring 15 which externally and internally embraces the upper edge of tank casing 3, which acts as a main support for the complete suction mechanism 14. The locking ring 15 has a central, flush flanged hub 16 engaging to casing 3 a substantially axially symmetrical exhauster 17, whose ventilator 18 is at the bottom and whose diameter-reduced electric motor 19 is at the top. A cap 21 is fixed to locking ring 15 in vertically spaced manner by spacers (not shown), accompanied by the interposing of an intermediate ring 20. Exhauster 17 is fixed in centered manner between locking ring 15 and cap 21, accompanied by the interposing of centering rings 22 and a damping ring 23. In the vicinity of the ring gap between the top of locking ring 15 and the bottom of the disk-like intermediate ring 20, the blow-off outlets 24 located in the upper area of ventilator 18 are surrounded by a filter ring 25, which is also secured in centered manner between locking ring 15 and intermediate ring 20. The suction opening or openings 26 of ventilator 18 are substantially symmetrical to the central axis of the cleaner on its lower end face. The switch 27, optionally a control light and the cable supply for the supply lead are provided on the circumference of cap 21 for the purpose of switching the exhauster 17 on and off. The associated electrical circuitry are located in protective manner within cap 21. A grip cap 28 forming a bow grip is fixed to the top of cap 21 and on it can be held the complete suction mechanism 14. For the sealed securing of the suction mechanism 14 against the upper tank end face, the outer circumference of the tank carries two diametrically facing turnbuckles, which are in each case above the handles 8 and which are in the form of e.g. wire eccentric clips. In the release position, they move with their upper ends bent in hooklike manner towards the central axis of tank 1 over the upper, annular end face of locking ring 15 and then by pressing down handles can be resiliently clamped against the upper end face, so that, accompanied by the interposing of a gasket ring 30, locking ring 15 is clamped taut against the upper end face of the tank casing 3.

The suction opening 26 of ventilator 18 is, in the operating position, and has located in the uppermost area and in the axis of tank 1, is associated therewith a float valve 31 which, even in the case of the slightest liquid action, closes the suction opening 26 with respect to vacuum chamber 6. Float valve 31 has a substantially cylindrical float 32, whose diameter is approximately one third of the tank diameter and on whose slightly larger diameter end face is provided an e.g. annular packing ring 33 as a valve closing member. The bottom of a lower, annular end wall 34 of flanged hub 16 of locking ring 15 is associated as a valve seat with packing ring 33 and on its top surface is placed under tension by the ventilator 18, accompanied by the interposing of a sealing and centering ring 22. Float 32 is carried in a support cage 35 formed from wound wire sections and consequently offers no significant resistance to flowing or spraying water. Its upper end ring is placed in centered manner on the outer circumference of the end wall 34 of locking ring 15 and is therefore secured in its equiaxial position with respect to suction mechanism 14 of tank 1. Between the upper end ring 36 and two lower, concentric end rings 37, 38 are provided upright wire portions, one group which is uniformly distributed over the circumference is located radially further to the outside, while the other group uniformly distributed over the circumference is located radially further to the inside. The inner group of wire portions with limited spacing below end ring 36 forms supporting shoulders by corresponding angular bends and on said shoulders rests float 32 in its lower valve open position with the ring shoulder 40 formed by its upper, widened end portion. The thus constructed float valve 31 consequently forms a unit part constructionally combined with suction mechanism 14 which, e.g. can be used for cleaning the valve closing member 33, but can easily be detached by removal from suction mechanism 14. The bottom of support cage 35 is only just above the center of the height of tank 1.

Vacuum chamber 6 is designed for receiving a waterproof filter, namely a wet filter 41, in the form of a flexible filter bag, which is approximately cylindrical in the widened state and which is made from a paper web or the like with high liquid permeability, whose width is only slightly smaller than the internal diameter of vacuum chamber 6. Wet filter 41, in the form of a disposable filter, is interchangeably arranged in its filter housing, which is essentially formed by a coated, gauze-like textile covering 42 and a planar, perforated bottom 43, which is fixed to the lower end thereof. In the widened state, textile covering 42 is only slightly wider than wet filter 41 and is less wide than the internal diameter of vacuum chamber 6. The circular disk-shaped bottom 43, which is substantially uniformly perforated over its entire surface, is fixed by an edge collar to the lower end portion of textile covering 42 in such a way that it is in a plane at right angles to the tank axis in the operating position. The upper end of textile covering 42 is fixed to the outer circumference of the lowermost portion of a cross-sectionally, upwardly, twice radially outwardly stepped profile ring 44, whose uppermost step portion removably rests in radially outwardly overengaging manner on the upper annular end face of the tank casing 3 after removing its cover 4. The upper edge 45 of wet filter 41 is outwardly turned over the upper end face of profile ring 44, so that after fixing the tank cover 4 between the upper end face of the profile ring 44 and the packing ring 30, it is held in sealed manner by jamming. After removing the tank cover 45, edge 4 of wet filter 41 can be turned back again and e.g. by gathering up, the upper opening of wet filter 41 can be closed, so that the e.g. dirt-filled wet filter 41 can then be moved in the form of a bag alone, or together with the filter housing from the vacuum chamber 6.

A connecting piece 47 is associated as a suction connection 46 with the suction mechanism 14 and/or the vacuum chamber 6. With an approximately radial axis above half the height of the filter housing, said connecting piece is inserted in the tank casing 3. The connecting piece 47 projecting radially into the interior of vacuum chamber 6 forms with its upper end an outlet 48, which is protected at the top and at the radially inner end in the direction of float valve 31 by a corresponding configuration of the connecting piece walls. In the represented embodiment, the outlet 48 is roughly in a plane, which is approximately at an angle of 45° to the axial plane of vacuum chamber 6 passing through it and increases slightly radially inwards. Thus, the water entering the tank flows in downwardly sloping manner and approximately tangentially into the wet filter 41, so that there is scarcely any risk of water splashing upwards and being pulled through the suction flow into the ventilator 18. For connecting piece 47, which is circumferentially substantially cylindrical or tapers slightly conically towards its radially inner end, textile covering 42 of the filter housing has a slightly smaller diameter circular opening 49, by means of which covering 42 is placed under tension and consequently in securely seated manner over connecting piece 47. By removing textile covering 42 from connecting piece 47, the filter housing can be raised from vacuum chamber 6 in the described manner. A corresponding passage opening 50 is also provided in the covering of wet filter 41. In the vicinity of passage opening 50, a flat reinforcement of a rubber-elastic plastic sheet or the like is fixed e.g. by sewn seams to the inside of wet filter 41. The reinforcement is provided with a central hole corresponding to the external cross-section of connecting piece 47. In the vicinity of passage opening 50, wet filter 41 can be opened by cutting a cross-shaped separating cut with a length which is roughly the same as the diameter of the passage opening, so that the approximately triangular tabs 52 separated from one another by the said cuts pass inwards through reinforcement 51 on mounting wet filter 41 on connecting piece 47 and project into said filter. Thus, these tabs 52 contribute to the sealing engagement of wet filter 41 on the circumference of connecting piece 47.

A suction port or in the represented embodiment all the suction ports 54 of a filtered water recycling mechanism 53 preferably open into the lowermost region of intermediate reservoir 7, in the vicinity of its bottom 3.

Recycling mechanism 53 has a pump 55, constructed in the manner of a submersible pump and which is structurally combined with an electric motor 56. Motor 56 is equiaxially fixed to the top of the pump and is peripherally provided in its lower region with suction ports 54. Pump 55 is fixed in tank 1 standing on bottom 2. Electric motor 56 can be supplied with power by means of a separate switch (not shown), e.g. fixed to the tank casing 3 and a corresponding supply lead, or can be connected by appropriate means to the electric circuitry in cap 21, e.g. by means of a detachable line coupling. The electric lead to electric motor 56 contains a float switch 57, which is connected by means of a flexible insulated cable, led in sealed manner out of the motor casing and is located in freely movable manner in intermediate reservoir 7. Upon reaching a predetermined water level in intermediate reservoir 7, the float switch 57 floats in a predetermined position, which is fixed by its weight distribution, so that electric motor 56 is switched on until, through the pumping out of the water in reservoir 7, the water level has dropped to a predetermined lower level at which point pump 55 is switched off again. The outlet of pump 55 is connected to the lower end of a pressure line 59 led upwards in intermediate reservoir 7 and which below the bottom 43 of the filter housing is led outwards through tank casing 3 and is connected to a plug-in connection 60 fixed to casing 3. Pressure line 59 contains a check valve 61, which closes in the case of a vacuum on the side towards pump 55, so that in this case no water can flow back through the pump into intermediate reservoir 7.

For using the cleaner, by means of a suitable coupling, one end of a suction hose is connected to the outer end of connecting piece 47, whilst the other end is provided with a suitable suction or pool cleaning head. Once again by means of a suitable coupling, an adequately long hose, which can sink into the water, is connected to the plug-in connection 60. The cleaner is set up with the wheel frame 9 close to the edge of the pool, the sinkable hose is let down into the water-filled pool and the suction head or the like is introduced into the pool water. After switching on the cleaner or suction mechanism 14, accompanied by the closing of check valve 61, a vacuum is built up in vacuum chamber 6 and as a result the dirty water is sucked through outlet 48 into wet filter 41 and after passing in filtering manner through the latter from inside to outside is collected in intermediate reservoir 7. As soon as the waterline in intermediate reservoir 7 has reached the predetermined level, pump 55 is switched on by remote switch 57, so that it pumps out the water collected against the vacuum in tank 1, while maintaining or increasing this vacuum. This is accompanied by the opening of check valve 61 and the recycling of water back to the swimming pool.

Parts of the cleaner, or even the complete cleaner, can be used for dry suction, in the manner of a vacuum cleaner, apart from the aforementioned water cleaning function. The suction mechanism 14 can be removed with the cover 4 and, using another filter 41 constructed as a dust filter, can be placed on another tank, whose upper area is substantially the same as the represented tank 1, but which has no recycling mechanism 53 and can consequently have a reduced overall height. In this case, the dry filter has no passage opening, so that the outlet 48 is located on its outside and the flow to be filtered traverses the filter from the outside to the inside. Thus, the dirt particles are deposited on the outside of the filter and drop downwards into the tank, in which they are collected up to the time of emptying. However, it is also conceivable for operating the cleaner as a vacuum cleaner to provide a dust-proof cover for the recycling mechanism 53, so that it can be left in tank 1, but is not subject to the action of the dirt collected in intermediate reservoir 7. Thus, as a function of the cleaner use, the detachable dust cover would be inserted or removed from tank 1. As the cleaner can always be moved when cleaning the swimming pool, it is possible to use a relatively short suction hose. Moreover, the cleaner can also be used as a water raising pump, e.g. for watering gardens, draining flooded cellars, etc.

What is claimed is:

1. A mobile cleaner for a liquid receptacle, comprising:

a mobile tank (1) with a liquid; in use, defining an upper surface, means defining a liquid flow path including a liquid suction connection (46) forming an inlet to the mobile tank (1) from the liquid receptacle, for bringing liquid to be cleaned from the receptacle to a chamber (5, 7) in the tank (1), a liquid recycling mechanism (53) operable to forcibly expel the liquid from a lower part (7) of the tank (1) to the receptacle, and means defining an air containing space (6) being maintained in the tank (1) above said upper surface, a suction mechanism (14) connected to the liquid suction connection (46), the suction mechanism (14) being operable to forcibly expel air from said air containing space (6), the liquid recycling mechanism (53) having a pressure connection (60) for discharging the liquid from the tank (1), the suction mechanism (14) and the liquid recycling mechanism (53) each having a suction side (26, 54) and a pressure side (24, 59), said suction sides (26, 54) of the liquid recycling mechanism (53) and of the suction mechanism (14) being both connected to the chamber (5, 7), thereby forming a vacuum chamber (6), the suction mechanism (14) having an air suction device (17) operable to produce a suction in the tank (1) apart from the liquid flow path and apart from said liquid recycling mechanism (53), and a wet filter (41) arranged in the liquid flow path upstream of the liquid recycling mechanism (53), said wet filter (41) forming a jacket having an inside connected to said suction side (26) of the suction mechanism (14) and to said inlet to the mobile tank formed by said liquid suction connection (46), wherein a substantial part of the wet filter is positioned above said upper surface of the liquid.

2. A cleaner, according to claim 1, wherein between a suction side (54) and the pressure connection (60) of the liquid recycling mechanism (53) is provided a check valve (61) which closes in the case of an overpressure on the pressure connection.

3. A cleaner according to claim 2, wherein the check valve (61) is constructed as a leaf valve located in a pressure line.

4. A cleaner according to claim 1, wherein the suction side (54) of the liquid recycling mechanism (53) and the vacuum chamber (6) are superimposed in a common main chamber.

5. A cleaner according to claim 4, wherein the vacuum chamber (6) is defined in part by a pressure-tight area above said upper surface, defining an upper end of an intermediate liquid reservoir (7) in the main chamber.

6. A cleaner according to claim 4, wherein at least one suction port of the inlet side (54) of the liquid recycling mechanism is located in the immediate vicinity of a bottom of the main chamber.

7. A cleaner according to claim 4, wherein a pressure line (59) of the liquid recycling mechanism is led in pressure-tight manner out of the main chamber.

8. A cleaner according to claim 1, wherein the suction side 54 of the liquid recycling mechanism (53) and the vacuum chamber (6) are located in an upright elongated tank.

9. A cleaner according to claim 1, wherein the suction mechanism (14) and the liquid recycling mechanism (53) are formed by separate units.

10. A cleaner according to claim 1, wherein the liquid suction mechanism is formed by a motorized exhauster.

11. A cleaner according to claim 1, wherein the liquid recycling mechanism is controlled with a liquid level sensing switch as a function of said upper surface in the cleaner.

12. A cleaner according to claim 1, wherein the wet filter is positioned entirely above said upper surface.

13. A cleaner according to claim 1, wherein the suction mechanism (14) is arranged on the top of the vacuum chamber (6) and with the suction side (26) detachably closes the vacuum chamber at an upper opening and detachably engages into the wet filter (41).

14. A cleaner according to claim 1, wherein a casing part (15) of the suction mechanism forms a tank cover.

15. A cleaner according to claim 1 wherein the suction connection (46) issues in downwardly sloping manner into the wet filter (41) below the suction side of the suction mechanism.

16. A cleaner according to claim 1, wherein the suction connection (46) is formed by a connecting piece inserted radially into the tank wall and the wet filter (41) has an insertion opening therefor.

17. A cleaner according to claim 1, wherein the suction mechanism is arranged on top of the vacuum chamber and with the suction side detachably closes the vacuum chamber at an upper opening, said suction side engaging the wet filter (41).

18. A cleaner according to claim 17, wherein said liquid recycling mechanism (53) has a liquid pump arranged in the form of a submersible pump below the vacuum chamber (6) on a bottom of the main chamber.

19. A cleaner according to claim 1, wherein the liquid recycling mechanism is formed by a motorized pump, which is constructionally combined with the tank.

20. A cleaner according to claim 1, wherein the wet filter is constructed as a replaceable filter.

21. A cleaner according to claim 1, wherein the liquid suction mechanism forms a ring locking means for the wet filter.

22. A cleaner according to claim 1, wherein the wet filter (41) is fixed by jamming an upper, outwardly turned edge of the wet filter (41) against a profile ring (44) sealing a top of the vacuum chamber (6).

23. A cleaner according to claim 22, wherein the profile ring (44) carries the filter housing (42), said profile ring being plurally, radially, inwardly stepped from a top to a bottom.

24. A cleaner according to claim 1, further comprising a wheel frame with self-guiding casters.

25. A cleaner according to claim 24, wherein the wheel frame has a mounting support forming a stand chassis for the removable arrangement of the tank.

26. A cleaner according to claim 1, wherein for receiving the wet filter, a filter housing (42) in the form of a flexible cover is provided, with a dimensionally stable, perforated bottom.

27. A cleaner according to claim 26, wherein the filter housing has a lateral opening (49) for sealed passage of the suction connection (46).

28. A cleaner according to claim 26, wherein the flexible cover is made of a coated textile.

29. A wet filter according to claim 28, wherein the filter has the shape of a bag, the insertion opening being in a circumferential wall of the bag.

30. A wet filter according to claim 28, wherein the filter is formed from paper.

31. A wet filter according to claim 1 or 28, wherein the liquid receptacles are swimming pools.

32. A cleaner according to claim 1, wherein said suction mechanism (14) is convertible between a first condition in which the suction mechanism is operable for sucking air out of the vacuum chamber (6) and a second condition in which the suction mechanism is out of operation with respect to evacuation of said vacuum chamber (6), means being provided for converting said suction mechanism (14) between the first and second conditions as a function of rising liquid, said means (32) being located below and in front of said suction side (26) of the suction mechanism (14).

33. A cleaner according to claim 32, wherein said means (32) are secured to said suction mechanism (14) by a liquid permeable support (35) substantially coaxial with said suction side (26) of the suction mechanism (14).

34. A cleaner according to claim 32, wherein said means comprise a float valve associated with a suction port of the suction mechanism (14).

35. A cleaner according to claim 34, wherein the float valve is provided with a float in a tank axis, said float being captured in a support cage for the wet filter (41) constructionally combined with the suction mechanism and engaging in said wet filter.

36. A cleaner according to claim 35, wherein the valve closing member of the float in an initial position is roughly at a height equal to the suction connection (46) adjacent to its circumference.

37. A cleaner according to claim 30, wherein the wet filter is formed from a web with high hydraulic permeability having an insertion opening for tightly receiving the suction connection.

38. A wet filter according to claim 37, wherein the insertion opening is formed by a sleeve (51) fixed to its inside and having an elastically bounded passage opening (50) for the suction connection (46).

39. A wet filter according to claim 37, wherein the insertion opening (50) is formed by a flat, flexible reinforcement (51).

40. A wet filter apparatus, comprising:

a mobile air-tight canister (1) with a liquid, in use, defining an upper surface, having an inlet (46) for attachment to a conduit for supply of liquid to be cleaned, an outlet (60) for discharging cleaned liquid and a filter medium (41) forming a jacket disposed in a liquid flow path defined between the inlet (46) and the outlet (60);

a liquid pump (53) operable to pump liquid from a lower part (7) of the canister (1) to the outlet (60), and a vacuum chamber (6) being maintained in the canister (1) above said upper surface apart from the liquid flow path as the liquid is supplied to the inlet (46) and discharged from the outlet (60); and, an air pump (17) operable to discharge air from the upper portion (7) of the canister (1), a suction side (26) of said air pump (17) being connected to the inside of said jacket, wherein the air pump (17) efficiently maintains a vacuum and the liquid pump (53) efficiently maintains liquid discharge, and said air pump (17) engages into said filter medium (41), supported by means of an inner support member (35), wherein a substantial part of the wet filter is positioned above said upper surface of the liquid.

* * * * *